United States Patent [19]

Oterdoom

[11] 4,083,134

[45] Apr. 11, 1978

[54] SUCTION HEAD FOR DREDGERS

[75] Inventor: Klaas Oterdoom, Bentveld, Netherlands

[73] Assignees: Anglo Dutch Dredging Co. Ltd., Beaconsfield, Great Britain; Amsterdamse Ballast Bagger en Grond, Amsterdam, Netherlands

[21] Appl. No.: 740,760

[22] Filed: Nov. 10, 1976

[30] Foreign Application Priority Data

Nov. 10, 1975 Netherlands ..... 7513146

[51] Int. Cl.[2] ..... E02F 3/88

[52] U.S. Cl. ..... 37/58; 37/57; 37/66; 15/422; 302/15

[58] Field of Search ..... 37/58, 57, 61, 62, 63, 37/66; 15/383, 422, 378, 375; 302/58, 15

[56] References Cited

U.S. PATENT DOCUMENTS

| | | | |
|---|---|---|---|
| 411,183 | 9/1889 | Bowers | 37/66 |
| 1,527,828 | 2/1925 | Barr | 15/422 UX |
| 3,761,997 | 10/1973 | Frazier | 15/422 |

FOREIGN PATENT DOCUMENTS

| | | | |
|---|---|---|---|
| 2,341,051 | 2/1974 | Germany | 37/66 |
| 2,247,457 | 4/1973 | Germany | 37/63 |
| 382,606 | 3/1963 | Japan | 37/57 |
| 1,056,632 | 1/1967 | United Kingdom | 37/63 |

*Primary Examiner*—Clifford D. Crowder
*Attorney, Agent, or Firm*—Snyder, Brown & Ramik

[57] ABSTRACT

A trailing dredger comprises a vessel, a pump, a suction pipe connected with said pump and a suction head connected with said suction pipe and having a suction chamber having at least one suction opening and communicating with the suction pipe, said suction head being adapted to roll along a soil beneath the water by means of a hollow roller being freely rotatable about an axis transverse of the direction of movement of the dredger and being journalled on the suction head, said roller being provided with a contact surface. The surface of the roller is provided with openings which concentrate the suction force and present an ever-changing contact pattern with the soil which correspondingly provides an ever-changing flow pattern to erode and pick up the soil.

7 Claims, 12 Drawing Figures

SUCTION HEAD FOR DREDGERS

Figures 1, 2, 3, 4, 5, 6, 7, 8, 9, 10, 11, 12:
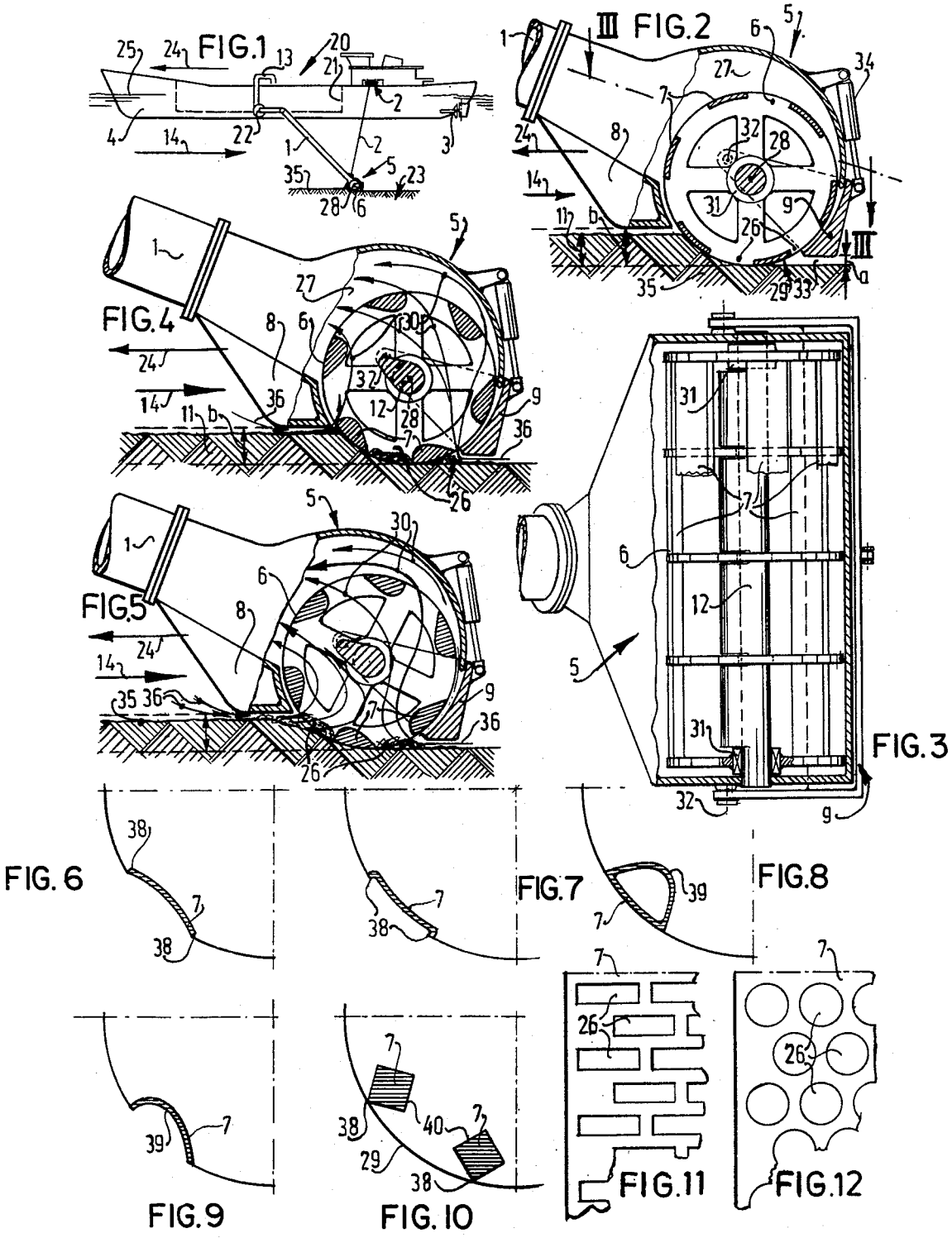

The invention relates to a trailing dredger comprising at least a vessel, a pump, a suction pipe connected with the pump and a suction head connected with said suction pipe and having a suction chamber provided with at least one suction opening and communicationg with the suction pipe, said suction head being adapted to roll along a soil beneath the water by means of a roller, which is freely rotatable about an axis transverse of the direction of travel of the trailing dredger and journalled on the suction head and provided with a contact surface.

Such a trailing dredger is known. The roller thereof has a closed, cylindrical contact surface and it is arranged in front of the suction chamber. Rolling the suction head onward requires considerably less energy than dragging it on. Both the roller suction head of the kind set forth and the known dragged suction head involve the difficulty that the strongly compacted soil cannot be readily sucked up. For loosening the compact soil a further trailing dredger is known, in which the suction chamber held on the ground by a trailing support accommodates a preferably driven cutting rotor, which lifts lumps of soil from the ground by means of spades and elevates the same into the suction chamber, in which the released lumps should be lifted by the suction force of the suction pipe, which, however, is not or hardly performed in practice because the suction force of the suction pipe is not or hardly able to act upon the lumps carried by the spades. This rotor tends to be filled with earth, particularly sticky earth so that the suction head is wholly or partly clogged.

The invention has for its object to minimize the energy required for the displacement of the suction head and to ensure that even compact soil is sucked up to an efficient extent. For this purpose the roller is arranged inside the suction chamber, is substantially closed at its head faces, has a plurality of suction openings mainly only in its contact surface and can be traversed by the flow, the suction openings being distributed in the circumferential direction across the contact surface. Witbh the trailing dredger embodying the invention the compact soil is agitated by the discontinuous contact surface of the roller, after which it can be readily sucked up across the roller allowing the flow to pass. The discontinuous contact surface locally exerts mechanical forces on the ground, which loosen the soil and the discontinuous suction openings produce continuous variations of the flow pattern, so that a high erosive effect of the ground is obtained.

The invention will be described more fully hereinafter with reference to a drawing.

In the drawing:

FIG. 1 is a schematic side elevation of a trailing dredger in accordance with the invention, FIG. 2 is an enlarged sectional view of the suction head of the trailing dredger shown in FIG. 1, FIG. 3 is a sectional view taken on the line III—III in FIG. 2, FIGS. 4 and 5 are sectional views of a different suction head of the trailing dredger embodying the invention in different positions, FIGS. 6 to 10 are sectional views of a ground support of a roller of individually different dredgers in accordance with the invention, and FIGS. 11 and 12 are exploded views of the contact surface of a roller of different trailing dredgers embodying the invention.

The trailing dredger 20 embodying the invention comprises a vessel 4 travelling in the direction 24 on water 25 against the direction of current 14 and having a hold 21, a pump 22, a suction pipe 1 pivotally connected with the vessel 4 and being movable up and down by means of elevating means 2 an a suction head 5 connected with the suction pipe 1. The suction head 5 comprises a suction chamber 27 communicating with the suction pipe 1 and can be rolled across a ground 23 beneath the water 25 by means of a roller 6, which is freely rotatable about an axis 28 transverse of the direction of travel 24 in bearings 31 on the suction head 5.

According to the invention the roller 6 is arranged inside the suction chamber 27 and has a plurality of suction openings 26 in the suction chamber 27 and in the contact surface 29, the roller 6 being traversible by sucked-up suspensions of earth and water. The openings 26 are presented between the members 7 and define a pattern of circumferentially spaced openings 26 in the roller 6.

FIGS. 3 and 4 show that the suspension flows along the lines of flow 30 through the roller 6 and round about the stationary tubular shaft 12, which preferably has a streamline-profile (see FIG. 4).

Referring to FIGS. 2 to 10 the contact surface 29 is mainly formed by a pluraliuty of axial ground supports 7 — for example six — leaving free axial, slot-shaped suction openings 26 between them.

A direction-finder 9 is arranged on the suction head 5 so as to be pivotable about an axis 32 and is adjustable by means of a screw-jack 34 to vary the width *a* of the gap 33 between the direction-finder 9 and the worked ground 35, the quantity of water required to come in through said gap 33 being thus regulated. On the front side the suction head 5 has a support 8 to determine the maximum thickness *b* of the ground layer 11 to be sucked up.

Referring to FIGS. 4 and 5, the flow pattern of the effluent water varies along the effluent lines 36 because the position of the roller 6 constantly varies. This alternating flow pattern brings about a drastic erosion of the ground layer 11, which is particularly advantageous on sandy, but densely compact ground. The contact surface 29 may be formed by plate-shaped, cylindrically curved ground supports 7 (see FIG. 2). They preferably have two cutting edges 38 penetrating into the ground 35 to be worked (see FIGS. 6, 7 and 9). On the side remote from the contact surface 29 each ground support 7 has a flow guide or modifier 39 (FIGS. 8 and 9).

Referring to FIG. 10 the contact surface 29 is formed by a plurality of ground supports 7 — for example eight — having a square profile so that they have a cutting edge 38 pointing to the ground and, moreover, a reasonable effluent profile 40 on the side remote from the contact surface 29. The suction openings 26 may be formed by holes in the contact surface 29, said holes being, for example, circular (FIG. 12) or rectanglr (FIG. 11) and in each case a circumferentially spaced pattern of openings is defined.

The dredging operation of each trailing dredger 20 is performed as follows.

The trailing dredger 20 travels in the direction 24 and rolls the suction head 5 along the ground 35 to be worked. The ground supports 7 agitate the earth of the ground 35, whilst water enters along the effluent lines 36 through the suction openings 26 shifting in place an carries along the agitated earth. The suspension of earth and water flows through the roller 6 and is sucked up by the pump 22 through the suction pipe 1 and pumped via a pressure duct 13 into the hold 21.

At its ends the roller 6 is closed by round discs so that the whole quantity of incoming water is compelled to enter the roller 6 through the suction opening 26.

What we claim is:

1. In a trailing suction dredger for claiming soil from a ground surface that lies below a body of water, said suction dredger being of the type which includes a suction pump mounted thereon and having a suction pipe that connects a suction head to said suction pump, the improvement wherein said suction head comprises:

a housing defining a suction chamber, said housing being provided with forward and rearward edge portions and side portions to define a generally rectangular shaped bottom opening;

a cylindrical roller rotatably mounted within said suction chamber about a transverse axis, said roller having only a minor portion protruding from said bottom opening and substantially filling said bottom opening whereby said roller contacts the ground surface and is rolled therealong as the suction dredger is trailed by the moving vessel;

said roller having a plurality of openings spaced about the circumferential surface thereof whereby said suction force is transferred through said roller from said suction head and applied to the ground surface to excavate soil from said ground surface and convey same through said roller into said suction chamber and from said suction chamber via said suction pipe to said vessel, said suction force and the flow pattern into said suction head being constantly varied with respect to the ground surface due to the rolling of said roller whereby said openings are continuously relocated relative to said housing and thereby continuously redirect said suction force as it is applied to said ground surface, and said forward edge being higher than said rearward edge thereby to provide a step which extends in a downward and rearward direction so that as the suction dredger is trailed by said vessel during a dredging operation, said forward edge remains substantially at the original ground level and said roller excavates a layer of soil which is substantially as thick as the depth at which said roller protrudes from said bottom opening.

2. A trailing suction dredger as defined in claim 1 wherein said openings are of rectangular shape.

3. A trailing suction dredger as defined in claim 1 wherein said openings are of circular shape.

4. A trailing suction dredger as defined in claim 1 wherein flow modifiers are provided between two adjacent openings and extending inwardly of said circumferential surface of said roller to assist in the conveying of the excavated soil.

5. A trailing suction dredger as defined in claim 4 wherein each of said flow modifiers is provided with a cutting edge about its periphery.

6. A trailing suction dredger as defined in claim 1 wherein said rearward edge portion of said housing is adjustable is height whereby the amount of its downward extension can be varied.

7. In a suction dredger of the type comprising a floating vessel having a suction pump mounted thereon, a trailing suction pipe connected to said suction pump and extending downwardly from the vessel into contact with the ground surface, said suction pipe terminating in a suction head which picks up the dredger soil as it is trailed along by the vessel, the improvement wherein said suction head comprises:

a housing defining a suction chamber, said housing having front, rear and opposite edges defining a bottom opening of generally rectangular shape, said front edge being at a level higher than said rear edge whereby said opening is forwardly facing to allow said front edge to pass closely over the ground surface in front of the suction head while said rear edge passes closely over the new ground surface behind said suction head;

a cylindrical roller journalled freely within said housing and having a portion projection through said opening in the housing substantially completely to fill same and to provide an escarpment contacting surface as said suction head is trailed along the ground, said roller being hollow and having a pattern of spaced openings distributed throughout its circumferential surface such that each of said openings is of a size much smaller than the area of said opening in the housing whereby the openings in said projecting portion initially concentrate the suction action at selected areas of the escarpment contacted thereby and present an ever-changing pattern of flow into the interior of the roller as the suction head is trailed along the ground.

* * * * *